US006382997B2

(12) United States Patent
Semmeling et al.

(10) Patent No.: US 6,382,997 B2
(45) Date of Patent: May 7, 2002

(54) CONNECTOR COMPRISING AN ESD SUPPRESSOR

(75) Inventors: Ralph Semmeling, Vligmen; Jeroen Dekker; Marcel Meijer, both of Hertogenbosch; Johannes Van Woensel, Rosmalen; Albertus Van Zanten, Hertogenbosch; Bernardus Paagman, Schijndel, all of (NL)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/777,524

(22) Filed: Feb. 6, 2001

(30) Foreign Application Priority Data

Feb. 8, 2000 (NL) ..... 1014319

(51) Int. Cl.[7] ..... H01R 13/53
(52) U.S. Cl. ..... 439/181; 439/386; 257/530
(58) Field of Search ..... 439/181, 386, 439/336; 438/131, 467, 600; 257/530

(56) References Cited

U.S. PATENT DOCUMENTS 5,483,407 A 1/1996 Anastasio et al. ..... 361/56
5,897,388 A 4/1999 Minich ..... 439/181
5,967,856 A 10/1999 Meller ..... 439/700
5,970,321 A * 10/1999 Hively ..... 438/123
6,211,554 B1 * 4/2001 Whitney ..... 257/355

FOREIGN PATENT DOCUMENTS

WO WO 96/13926 5/1996
WO WO 96/41356 12/1996

OTHER PUBLICATIONS

"Parallel Channel Electrostatic Discharge Suppressor", IBM Technical Disclosure Bulletin, vol. 38, No. 2, 1995.

* cited by examiner

*Primary Examiner*—Neil Abrams
*Assistant Examiner*—Michael C. Zarroli
(74) *Attorney, Agent, or Firm*—Perman & Green, LLP

(57) ABSTRACT

The invention pertains to a connector having a grounding element and a housing of an electrically insulating material. The housing includes at least one contact element comprising a contact end, an intermediate part, and a connection end. The connector also includes an electrically insulating voltage variable medium that is provided between the at least one contact element and the grounding element. The electrically insulating voltage variable medium becomes electrically conducting at a voltage that is substantially higher than the operating voltages of a device for which the connector is intended or of which it is a part. The connector described herein is relatively compact and enables constant ESD suppression.

5 Claims, 1 Drawing Sheet

CONNECTOR COMPRISING AN ESD SUPPRESSOR

BACKGROUND OF THE INVENTION

1. Field of the Invention

The invention relates to a connector comprising a grounding element and a housing of an electrically insulating material, which housing comprises at least one contact element having a contact end, an intermediate part, and a connection end.

2. Description of the Prior Art

Such connectors are known from, e.g., international patent application PCT/IB95/00883 (publication number WO96/13926). This publication concerns a connector for connecting a radio telephone to its base station so as to enable signal and power transmission. Due to the frequent removal and repositioning of the radio telephone on its cradle, there is a need for a reliable connection over the life of the telephone whilst adjusting to the large tolerances in positioning. There is also a need to protect the circuitry of the base station, in particular from electrostatic discharges or ESD that could occur between an external device and the cradle connector or between the contact of the cradle connector when exposed to the environment as is the case when the telephone is removed. PCT/IB95/00883 further acknowledges a continuous demand on provision of more compact and cost effective connection systems and providing a cradle connector that is protected from electrostatic discharge in a cost effective, compact and reliable manner. To achieve the above-mentioned objectives, each of the contact elements is provided with a supple spring means between its connection end and its contact end and two or more contact elements are provided with extensions abutting against a short circuiting bar positioned within the connector.

SUMMARY OF THE INVENTION

It is an object of the present invention to provide a further improved connector comprising an electrostatic discharge suppressor.

To this end, the connector according to the present invention comprises an electrically insulating voltage variable medium that is provided between the at least one contact element and the grounding element. The electrically insulating voltage variable medium becomes electrically conducting at a voltage that is substantially higher than the operating voltages of a device for which the connector is intended or of which the connector is part of.

The connector according to the present invention allows, owing to the use of the electrically insulating voltage variable medium is a compact design. Thus, applications of the connector according to the invention is no longer restricted to larger devices, such as the above-mentioned cradles or base station, but can now also be used in smaller devices, such as mobile telephones.

Further, the connector according to the present invention provides electrostatic discharge suppression independent of whether or not the connector is connected to a counterpart or not. This may, for instance, prove especially advantageous in connectors for mobile devices, such as mobile phones or the like.

Electrostatic discharge typically involves a voltage in a range from say 10 to 15 kV. Thus, it is preferred that the voltage variable medium becomes electrically conductive at voltages higher than 1 kV, preferably at voltages higher than 5 kV so as to prevent short circuits from occurring during normal operation and, at the same time, provide effective protection against ESD and similar phenomena.

A very suitable voltage variable medium contains or consists of a polymer. Especially when the polymer is curable or thermosetting, application or inclusion of such a polymer in the connectors according to the present invention can be carried out relatively easily.

The invention is especially advantageous when used in a connector which comprises a plurality of contact elements and wherein the grounding element comprises a shorting or shunting bar that runs along at least some or each of the contact elements. It is preferred that such connectors further comprise a channel that accommodates both the medium and the shorting or shunting bar. Thus, the electrostatic discharge suppression provides simultaneous protection for a plurality or all of the contact elements and can be kept even more compact.

The invention further pertains to a butt-mount connector containing a voltage variable medium as described above. Butt-mount connectors allow compact design and are therefore often used in compact electronic devices. The present invention enables the use of electrostatic discharge suppressors in combination with butt-mount connectors without rendering the latter unsuitable for use in compact electronic devices.

DESCRIPTION OF THE DRAWINGS

The invention will be further explained by reference to the drawings in which an embodiment of the connector according to the present invention is schematically shown.

DETAILED DESCRIPTION OF THE PREFERRED EMBODIMENTS

Figure 1:
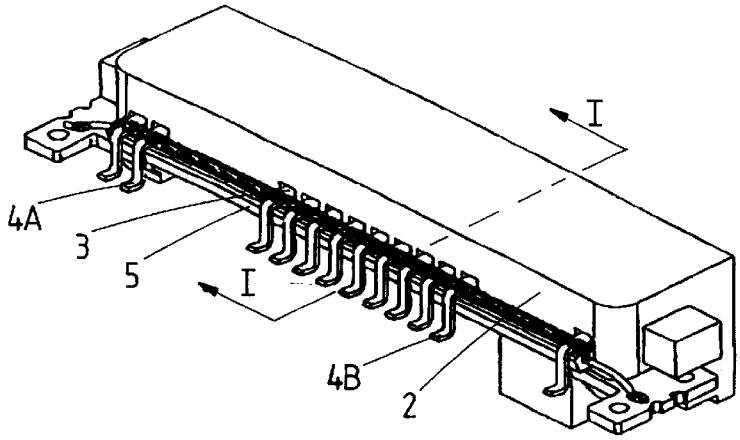
FIG. 1 shows a perspective view of an embodiment of the connector according to the present invention.

FIG. 1 shows in perspective a connector 1 comprising a housing 2 of an electrically insulating material, such as, for instance, a polyamide or a liquid crystalline polymer (LCP). The housing 2 is provided with twelve channels 3 (shown in more detail in FIG. 3), each of which accommodates a contact element 4.

This particular connector 1 comprises two power contact elements 4A, which are, for instance, used for power supply to the rechargeable battery of a mobile telephone, radio telephone or the like. The connector 1 further comprises signal contact elements 4B, which enable data communication between the device of which connector 1 is a part, such as a mobile telephone or a daughter board and respectively a cradle or back plane.

Figure 2:
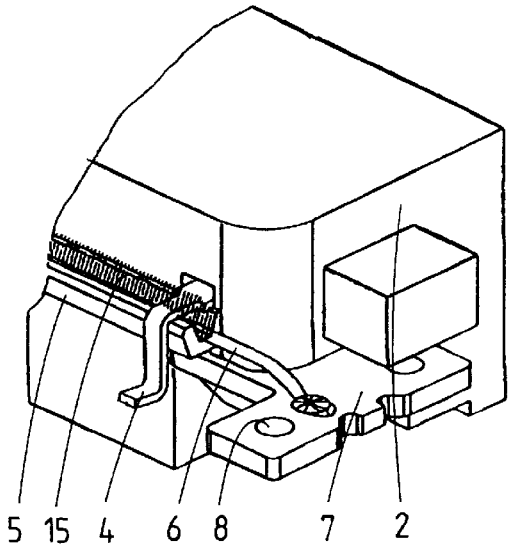
FIG. 2 shows a detail of the connector according to FIG. 1.

As shown in more detail in FIG. 2, the connector 1 further comprises a channel or trough 5, which runs beneath contact elements 4 and which is an integral part of the housing 2. The channel 5 accommodates a shorting or shunting bar 6 that is soldered to a grounding plane 7 on both sides of the channel 5 and the contact elements 4. The grounding plane 7 comprises fastening holes 8 for attaching the connector 1 to a substrate such as a printed circuit board or PCB (not shown). During or after the attachment of the connector 1 to the printed circuit board, the grounding plane 7 should be connected to the grounding of the printed circuit board.

Figure 3:
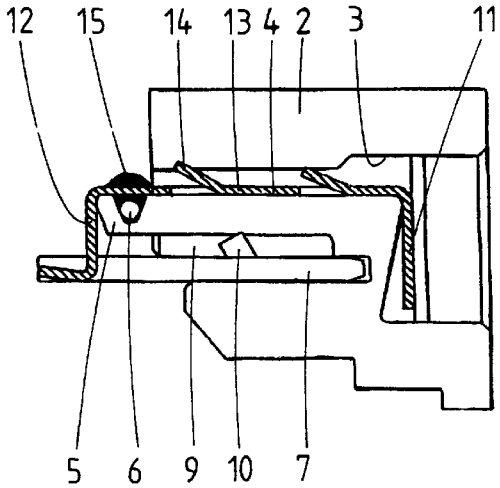
FIG. 3 shows a cross-section along plane I in FIG. 1.

FIG. 3 shows how the grounding plane 7 has been inserted into a slot 9 which runs the length of the housing 2. The grounding plane 7 is secured into the slot 9 by means of barbs 10. FIG. 3 further shows that each of the contact elements 4 comprises a contact end 11, a connection end 12 and an intermediate part 13. The intermediate parts 13 of the contact elements 4 are provided with lanced portions 14 that serve to secure the contact elements 4 in the channels 3. The resilient contact end 11 of each of the contact elements 4 provides a so-called butt-mount connection, thus enabling easy placement and removal of a mobile device into respectively from a cradle, base station or the like.

The channel 5 is filled with a voltage variable polymer 15, for instance obtainable from Littelfuse Inc. As can be seen in FIG. 3, the said polymer 15 fully surrounds both the shorting bar 6 and the contact element 4. During normal use, the power contacts 4A will operate at voltages varying in a range from approximately 3 to 5 Volts, whereas the signal contacts 4B will operate in the order to several millivolts. Thus, the shorting bar 6 is electrically insulated from the contact elements 4 except when the voltage in the contact elements 4 exceeds a specific threshold inherent to the polymer 11. The threshold voltage can, for example, reach the range from 1 to 8 kV. Voltages exceeding this threshold may occur during electrostatic discharge, in direct lightning, electrical fast transients (EFT) and system-generated transients.

Thus, the device of which the connector 1 according to the present invention is a part is protected against such occurrences. Further, the connector 1 according to the present invention allows a compact design due to efficient use of the space between the contact elements 4 and the shorting bar 8.

The invention is not restricted to the above described embodiment which can be varied in a number of ways within the scope of the claims. Further, the connector according to the present invention can be used in various applications such as telephone exchange devices used in telecommunications or in mobile telephones. The invention can also be used in connectors used in RS-232 ports and USB ports. Yet other applications are, for instance, video recorders and television sets.

What is claimed is:

1. An electrical connector comprising a grounding element and a housing of an electrically insulating material, the housing including a plurality of contact elements each having a contact end, an intermediate part, and a connection end, wherein an electrically insulating voltage variable medium is provided between the contact elements and the grounding element, which medium becomes electrically conducting at a voltage that is substantially higher than the operating voltages of a device for which the connector is intended or of which it is a part, the intermediate part of each contact element being provided with lanced portions adapted to secure each contact element in a channel within the housing, the grounding element comprising a shorting bar that runs along at least some or each of the contact elements, the channel accommodating both the voltage variable medium and the shorting bar.

2. A connector according to claim 1, wherein said medium becomes electrically conducting at voltages higher than 1 kV, preferably at voltages higher than 5 kV.

3. A connector according to claim 1, wherein said medium contains or consists of a polymer.

4. A connector according to claim 3, wherein said polymer is cured polymer.

5. Butt-mount connector according to claim 1.

* * * * *